US012702176B2

(12) United States Patent
Schneider et al.

(10) Patent No.: US 12,702,176 B2
(45) Date of Patent: Aug. 11, 2026

(54) ADJUSTMENT UNIT, FASTENING DEVICE AND WEARABLE ARTICLE

(71) Applicant: ON CLOUDS GMBH, Zürich (CH)

(72) Inventors: Damian Schneider, Zürich (CH); Alexandra Beeken, Zürich (CH); Zachary Runzo, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 101 days.

(21) Appl. No.: 18/222,073

(22) Filed: Jul. 14, 2023

(65) Prior Publication Data

US 2024/0023654 A1 Jan. 25, 2024

(30) Foreign Application Priority Data

Jul. 20, 2022 (CH) ..... 000868/2022

(51) Int. Cl.
*A41F 1/00* (2006.01)
*A41D 1/04* (2006.01)

(52) U.S. Cl.
CPC ..... *A41F 1/00* (2013.01); *A41D 1/04* (2013.01); *A41D 2300/32* (2013.01)

(58) Field of Classification Search
CPC ..... A41F 1/00; A41D 1/04; A41D 2300/32; F16G 11/14; F16G 11/101; Y10T 24/3984; Y10T 24/3909; Y10T 24/3713; Y10T 24/3969; A44B 11/16; A43C 7/00
See application file for complete search history.

(56) References Cited

U.S. PATENT DOCUMENTS 3,080,867 A 3/1963 Eichinger
4,328,605 A * 5/1982 Hutchison ..... F16G 11/101 24/136 R
4,393,550 A * 7/1983 Yang ..... A43C 7/00 24/115 G
5,224,245 A * 7/1993 Matoba ..... F16G 11/101 24/136 R
6,170,130 B1 * 1/2001 Hamilton ..... A45F 3/04 24/130
D584,942 S * 1/2009 Yoshie ..... D8/383
7,574,786 B2 * 8/2009 Cheng ..... F16G 11/101 24/712.2
D625,986 S * 10/2010 Kolasa ..... D8/356
D646,557 S * 10/2011 Chan ..... D8/367
(Continued)

FOREIGN PATENT DOCUMENTS

JP 6 056115 B2 1/2017
WO WO 2011/152399 A1 12/2011
WO WO 2013/073530 A1 5/2013

OTHER PUBLICATIONS

EPO, Munich, DE, EPO Form 1507N Jun. 2012, Communication with Form 1503 Mar. 1982, Ext. EP Search Report for European Patent Application No. EP 23 18 4571, Oct. 18, 2023 (7 pp).
(Continued)

*Primary Examiner* — Jason W San
*Assistant Examiner* — Rowland Do
(74) *Attorney, Agent, or Firm* — Pauley Erickson & Swanson

(57) ABSTRACT

An adjustment unit (1) with a main body and an adjustment unit hook element (3) protruding from the main body which can be used in an adjustment device (1), as well as a wearable article with such a fastening device (100).

17 Claims, 3 Drawing Sheets

(56) References Cited

U.S. PATENT DOCUMENTS

| | | | | |
|---|---|---|---|---|
| D668,137 | S * | 10/2012 | Kao | D8/383 |
| 2006/0130297 | A1* | 6/2006 | Liao | A43C 11/00 24/712.5 |
| 2014/0283301 | A1* | 9/2014 | Whaley | F16G 11/048 24/301 |
| 2014/0353346 | A1 | 12/2014 | Chapuis | |
| 2017/0200437 | A1 | 7/2017 | Lee | |
| 2018/0235323 | A1* | 8/2018 | Hung | A43C 7/00 |
| 2020/0008532 | A1* | 1/2020 | Chamberlain | A43C 1/00 |
| 2022/0287388 | A1* | 9/2022 | Thatcher | A41D 1/04 |
| 2024/0023656 | A1 | 1/2024 | Schneider et al. | |

OTHER PUBLICATIONS

EPO, Munich, Germany, EPO Form 1703 01.91TRI, European Search Report for European Patent Application No. EP 23 18 4570, Nov. 3, 2023 (8 pages).

* cited by examiner

ADJUSTMENT UNIT, FASTENING DEVICE AND WEARABLE ARTICLE

CROSS-REFERENCE TO RELATED APPLICATIONS

Swiss Patent Application No. 000868/2022, filed 20 Jul. 2022, the priority document corresponding to this invention, to which a foreign priority benefit is claimed under Title 35, United States Code, Section 119, and their entire teachings are incorporated, by reference, into this specification.

BACKGROUND OF THE INVENTION

Field of the Invention

The present invention lies in the field of fastening wearable articles, such as vests, backpacks, bags and the like to a wearer and relates to a fastening device, the use of such a fastening device as well as a wearable article including a fastening device.

Discussion of Related Art

Many different fastening devices for wearable articles with two shoulder straps are known in the prior art. One of the most common fastening device is known from backpacks in the form of buckle straps which extend from one shoulder strap of the backpack to the other and which can be snap fitted into a corresponding socket establishing a releasable form locking connection and fastening the backpack to the wearer. Functional backpacks, such as travelling or hiking backpacks, typically comprise two parallel extending buckle straps, i.e., straps which run in the connected configuration in parallel to each other, one extending over the breast area of the wearer securing the should straps tightly to the wearer's body and the other running over the hip and stomach area of the wearer, thereby fastening the backpack tightly to the lower back and further distributing luggage weight onto the wearer's hips.

A common problem associated with the above mentioned devices is that they are typically either fixedly connected to the shoulder straps, i.e., their position with respect to the shoulder straps (their height) cannot be adjusted at all, or their positioning can be adjusted along a certain distance, however, the straps cannot be fixed in a certain position with respect to the shoulder straps, which entails continuous movement and unwanted displacement of the fastening devices when worn.

Furthermore, adjustment of many known fastening devices, in particular tightening the fastening devices is cumbersome during certain activities such as running.

A further disadvantage of certain known fastening devices is that they often comprise loose sections with a relatively large movement range relative to each other. This is undesired, as it reduces the wearing comfort.

SUMMARY OF THE INVENTION

It is therefore the general object of the present invention to advance the state of the art in the field of fastening devices for wearable articles, in particular wearable articles having two should straps forming a shoulder loop, and preferably to overcome one or more of the disadvantages of the prior art fully or partly. In advantageous embodiments, a fastening device and a wearable article is provided which allows a fast and reliable adjustment of the positioning of the fastening device with respect to the shoulder straps (i.e., the height of the fastening device) and/or of the tightness of the fastening device. In further advantageous embodiments, a fastening device and a wearable article is provided which has an increased wearing comfort.

The general object is achieved by the subject-matter of the independent claims. Further advantageous embodiments follow from the dependent claims and the overall disclosure.

A first aspect of the invention relates to an adjustment unit for a fastening device, in particular for a fastening device as disclosed in any of the embodiments herein, in particular with respect to the second aspect of the invention. The adjustment unit comprises a main body, which comprises a first locking channel and a therefrom separated second locking channel. The first locking channel and the second locking channel can each be switched between a locking configuration and an open configuration. Furthermore, each locking channel, i.e., the first locking channel and the second locking channel, is biased into the locking configuration. In addition to the main body, the adjustment unit further comprises an adjustment unit hook element which protrudes from the main body and is configured to engage with a fastening cord. The adjustment unit hook element allows for engaging the adjustment unit at an additional position with a fastening cord, which increases the wearing comfort and the fit of the wearable article, even during excessive movements.

The opening configuration is a configuration in which the corresponding locking channel is open and in which a fastening cord which is arranged inside the channel can be longitudinally moved with respect to the adjustment unit. The locking configuration is a configuration in which such a longitudinal movement is prevented. Preferably, in the locking configuration the diameter of the corresponding locking channel is restricted as compared to the open configuration. The term "locking configuration" does however not mean that the corresponding locking channel must be completely closed, but it may also be a configuration in which the diameter of the corresponding locking channel is restricted as compared to the open configuration, but the locking channel does not necessarily have to be completely closed, although this may in some embodiments be the case. Particularly, in the locking configuration, the fastening cord may be clamped, respectively clampable, to the adjustment unit.

The term "longitudinally moved" means that the position of the corresponding element, such as the adjustment unit, a hook element, a cord holding receptacle and the like, along the fastening cord can be adjusted or changed. For this, either the fastening cord can be moved with respect to the cord holding receptacle and/or the cord holding receptacle can be moved along the fastening cord.

A "releasable locking connection" as used herein refers to a connection which is locked by itself, i.e., when not manipulated. Typically, a longitudinal movement of the fastening cord with respect to the central adjustment unit is therefore prevented. Furthermore, the term "releasable" means that the connection can be released without exertion of high forces and/or without destroying the connected parts. Therefore, cutting, sawing or tearing connected elements apart under exertion of high forces which destroys the structural integrity of the connected parts is not considered as releasing a locking connection and thus not as a releasable locking connection. Furthermore, a releasable locking connection can be released and rejoined multiple times without altering the structural integrity of the connected parts.

It is understood that the terms "first" and "second" as used herein are used to differentiate different elements. However this does not mean that the presence of such a "second" element necessarily must require the presence of a "first" element.

In some embodiments, the adjustment unit comprises a tubular housing portion. This tubular housing portion defines, respectively delimits: a compartment, a first pair of through-going openings which open into the compartment and a second pair of through-going openings which open into the compartment. Thus, in such embodiments, the tubular housing portion may comprise four through-going openings, which penetrate the tubular housing portion from the outside environment into the compartment. In addition, the through-going openings of the first pair are coaxially arranged to each other and also the through-going openings of the second pair are coaxially arranged to each other. Typically, however, a through-going opening of the first pair is not coaxially arranged with a through-going opening of the second pair.

In some embodiments, the one or more, in particular two, locking structure(s) are arranged partly or fully inside the compartment, wherein the one or more locking structure each defines a through-going locking structure opening. The one or more locking structure is arranged such that in the locking configuration, the locking structure opening may be fully or partly offset to the first pair or second pair of through-going openings defined by the tubular housing portion. Furthermore, the one or more locking structure is arranged such that the through-going locking structure opening is coaxially arranged with the corresponding pair of through-going openings defined by the tubular housing, e.g., with the first pair or with the second pair of through-going openings with which it is offset in the locking configuration. Preferably, the adjustment unit comprises two, particularly only two, of such locking structures. Thus, the adjustment unit may have a first locking structure with a through-going locking structure opening. This through-going locking structure opening is fully or partly offset in the locking configuration with the first pair of through-going openings. Accordingly, the adjustment unit may further have a second locking structure with a through-going locking structure opening. This through-going locking structure opening is fully or partly offset in the locking configuration with the second pair of through-going openings.

In some embodiments, biasing each locking channel into the locking configuration may be achieved by a resilient element providing a biasing force, such as a spring or an elastic polymer element. For example, a resilient element may be arranged between two locking structures pushing them apart from each other and each into its locking configuration. Preferably, the adjustment unit, and in particular the biasing element, is configured such that for switching from the locking configuration into the open configuration a biasing force biasing first locking channel and/or the second locking channel into the locking configuration must be overcome. The biasing force may for example be 0.5 N to 50 N, in particular 1 N to 25 N.

In some embodiments, the adjustment unit hook element defines a cord holding receptacle being configured for holding a fastening cord such that the fastening cord can longitudinally be moved through the cord holding receptacle.

In some embodiments, the cord holding receptacle is a cord holding groove with a groove wall which delimits the cord holding groove and defines a groove opening to the cord holding groove. Typically, the groove opening is a constricted opening, i.e., it is smaller than the diameter of the cord holding groove.

A groove as used herein is typically defined by a groove wall, which surrounds and delimits the groove, however has an opening which allows to insert the fastening cord. Thus, in cross-section perpendicular to the longitudinal extension of the groove, the groove wall has a gap which is the opening. In contrast, a channel as used herein has a channel wall which in cross-section perpendicular to the longitudinal extension of the channel completely circumferentially surrounds and delimits the channel. Both a groove and a channel typically have along the longitudinal direction two opposing distal inlets. In some embodiments, a groove as used herein may comprise a constricted opening. A constricted opening is an opening whose gap, i.e., the distance between the groove walls is constricted with respect to the groove diameter.

A second aspect of the invention relates to a fastening device for a wearable article, in particular a wearable article having two shoulder straps. The fastening device comprises two distal hook elements, an adjustment unit according to any of the embodiments as described herein, in particular with respect to the first aspect, and a fastening cord, particularly a single fastening cord. The fastening cord extends through the first locking channel and through the second locking channel. Furthermore, the adjustment unit is arranged between the two distal hook elements. The fastening cord connects the two distal hook elements and the adjustment unit with each other.

Particularly, the fastening cord extends through the first locking channel, which is preferably biased into the locking configuration. In this locking configuration, the fastening cord is preferably clamped to the, respectively by the, adjustment unit. From the first locking channel, the fastening cord extends to one of the distal hook elements and from there to the other one of the two distal hook elements and from there back to the adjustment unit, though the second locking channel, which is preferably also biased into the locking configuration. In this locking configuration, the fastening cord is preferably clamped to the adjustment unit. Typically, the fastening cord comprises two distal ends which are protruding from the first or second locking channel.

In some embodiments, the adjustment unit is configured such that it is biased into the locking configuration in which it forms a releasable locking connection with the fastening cord. The locking configuration of the adjustment unit may typically be achieved in that the first locking channel and the second locking channel are both in the locking configuration.

In some embodiments, the adjustment unit, particularly the first locking channel and the second locking channel, is configured such that longitudinally moving the fastening cord through the first locking channel and/or the second locking channel is possible in the open configuration. In particular embodiments, the one or more locking structures and the first pair and/or second pair of through-going openings are configured such that longitudinally moving the fastening cord through the first locking channel and/or the second locking channel is possible in the open configuration.

In some embodiments, the fastening cord has two distal ends protruding from the adjustment unit, respectively from the first and/or second locking channel. In preferred embodiments, the two distal ends are connected together, in particular by a form-locking, force locking and/or material bonded connection.

The fastening cord may in some embodiments be elastic.

In some embodiments, each hook element comprises a cord holding receptacle, wherein the cord holding receptacle is engaged with the fastening cord such that the cord holding receptacle is longitudinally movable with respect to the fastening cord. The cord holding receptacle may comprise a constricted opening which is constricted with respect to the cord holding receptacle.

In some embodiments, each hook element comprises, in addition to the, and therefrom separated, cord holding receptacle, one or more, in particular two, hooks. Such hooks are each being configured for connecting the fastening device with an engagement loop of the wearable article. In particular, such hooks may be configured for engaging with an engagement loop of the wearable article. In contrast to fixed connections such as stitching or gluing, such hooks allow to rapidly and easily adjust the height of the fastening device particularly with respect to the shoulder straps of the wearable article. In contrast to other releasable connections, such as knotting, hooks can be rapidly engaged and disengaged with the engagement loops and thus enhance the user-friendliness.

It is understood that these hook elements are different from a cord holding receptacle of the corresponding distal hook element. Preferably, the hook or hooks of a distal hook element are arranged opposite of the cord holding receptacle.

In some embodiments, each distal hook element comprises, or consists, of two hooks being arranged after one another and being spaced apart from each other. In certain embodiments, the two hooks of one of or of each of the distal hook elements extend in parallel to each other or extend inversely to each other.

In some embodiments, each hook defines a groove, which may be considered a hook groove. Particularly such a groove may have a round, e.g., circular or elliptic, cross-section. Preferably each hook defines a constricted groove opening. Typically, the constricted groove opening, respectively the gap between the groove walls is equal or smaller, in particular smaller, than the diameter of the fastening cord. As the hooks are generally at least to a certain extent flexible, their opening can be widened manually for inserting the fastening cord, but thereafter the fastening cord is secured within the groove.

In certain embodiments, each hook may essentially be S-shaped, respectively have the shape of a lower or upper half of an "S".

In some embodiments, each distal hook element comprises two hooks, particularly only two hooks, which are arranged one after another. Preferably, the two hooks are spaced apart from each other, particularly such that they define a gap between them. This makes the hooks themselves more flexible which simplifies introduction of the fastening cord.

In some embodiments, the two hooks of at least one of the distal hook elements, or of all of the distal hook elements, extend in parallel to each other or alternatively inversely to each other. Hooks which extend in parallel to each other can generally be considered as being congruent to each other such that they can be transformed into each other by linear translation. Inverse hooks can generally be considered as congruent to each other such that they can be transformed into each other by point inversion. For example, two hooks having an S shape, respectively the shape of a lower or upper half of an "S", and extending in parallel have the groove opening oriented into the same direction, while two hooks having an S shape, respectively the shape of a lower or upper half of an "S", and extending inversely to each other have the groove openings oriented in opposite directions.

A third aspect of the invention relates to a wearable article, in particular a backpack, a bag or a garment such as a vest, e.g., a running vest. The term "wearable" relates to an article which can be worn such that the article defines one or more receptacle structures such as a shoulder loop, for accommodating a body part of a wearer.

The wearable article according to the third aspect of the invention has a first shoulder strap and a therefrom separated second shoulder strap. Each shoulder strap forms a shoulder loop, which in the worn state surrounds the wearer's shoulder and/or arm. The first shoulder strap comprises at least two first engagement loops and the second shoulder strap comprises at least two second engagement loops. The wearable article according to the third aspect of the invention further comprises a fastening device according to any of the embodiments as described herein, particularly with respect to the second aspect of the invention. One of the two distal hook elements is engaged with one of the first engagement loops of the first shoulder strap and the other one of the two distal hook elements is engaged with one of the second engagement loops of the second shoulder strap. Thus, the two hook elements of the fastening device are engaged/connected such that the fastening device connects the first and second shoulder strap with each other and such that one of the hook elements is engaged with a first engagement loop of the first shoulder strap and the other one of the two hook elements of the fastening device is engaged with a second engagement loop of the second shoulder strap.

Typically, the adjustment unit is arranged between the two hook elements.

In some embodiments, the adjustment unit is a central adjustment unit. This means, the distance between the adjustment unit and each one of the distal two hook element is essentially the same, preferably the same.

In some embodiments the two distal ends of the fastening cord may be protruding freely from the central adjustment unit, i.e., they are not attached or mounted to any other element, but preferably only to the central adjustment unit.

Typically, the majority of the remaining part of the fastening cord extends between the central adjustment unit and the two hook elements In some embodiments, the adjustment unit hook element is engaged with the fastening cord, in particular with a section of the fastening cord which extends between the two distal hook elements, thereby forming a releasable connection with the fastening cord. This section of the fastening cord, which may be a second section of the fastening cord, is defined as a section extending between the two hook elements, but typically not forming a releasable locking connection with the adjustment unit. Typically, a first section of the fastening cord extends between the one distal end of the fastening cord via the adjustment unit and one of the distal hook elements and a third section extends between the other distal end of the fastening cord via adjustment unit and the other one of the distal hook elements. Engaging the hook of the adjustment unit with the second section of the fastening cord increases the wearing comfort and the fit of the wearable article, even during excessive movements. The adjustment unit hook element may in some embodiments be a hook which is equal to the hooks as described herein with respect to the distal hook elements, e.g., the adjustment unit hook may have an "S"-shape as described herein above for the hooks of the distal hook elements. The adjustment unit hook may also have a U-shape or V-shape.

In some embodiments, the first shoulder strap comprises at least 3, particularly at least 4, particularly at least 6, particularly at least 8, first engagement loops and the second shoulder strap comprises at least 3, particularly at least 4, particularly at least 6, particularly at least 8, second engagement loops. In some embodiments, the first shoulder strap comprises 3 to 20, particularly 4 to 15, more particularly at least 6 to 15, more particularly at least 7 to 12, first engagement loops and the second shoulder strap comprises 3 to 20, particularly 4 to 15, more particularly at least 6 to 15, more particularly at least 7 to 12, second engagement loops.

In certain embodiments the number of first engagement loops and the number of second engagement loops is equal.

In some embodiments, the first engagement loops and the second engagement loops may each be formed from a single string which is only section-wise attached, for example by gluing, fusing or stitching, to the first shoulder strap, respectively the second shoulder strap, in such a manner that the non-attached portions form the first, respectively second engagement loops. In some embodiments, the first engagement loops and the second engagement loops may be daisy chain loops.

In some embodiments, the wearable article comprises at least two, particularly only two, fastening devices according to any of the embodiments as described herein, in particular with respect to the second aspect of the invention. Preferably these fastening devices extend in parallel to each other. In some embodiments, the fastening cords of the two fastening elements extend in parallel to each other.

The wearable article may in some embodiments be a backpack, a bag or a garment such as a vest, e.g., a running vest.

In some embodiments, the adjustment unit is not engaged with or directly in contact with the first and/or second engagement loops, respectively the first and/or second shoulder strap. In some embodiments, the central adjustment unit may only be indirectly connected with the first and/or second engagement loops via the fastening cord and the corresponding two hook elements of the fastening device.

A fourth aspect of the invention relates to the use of a fastening device according to any of the embodiments described herein, in particular with respect to the second aspect of the invention. Preferably, the fastening device is used for or in combination with a wearable article, particularly for fastening a wearable article to a wearer.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DESCRIPTION OF PREFERRED EMBODIMENTS

Figure 1:
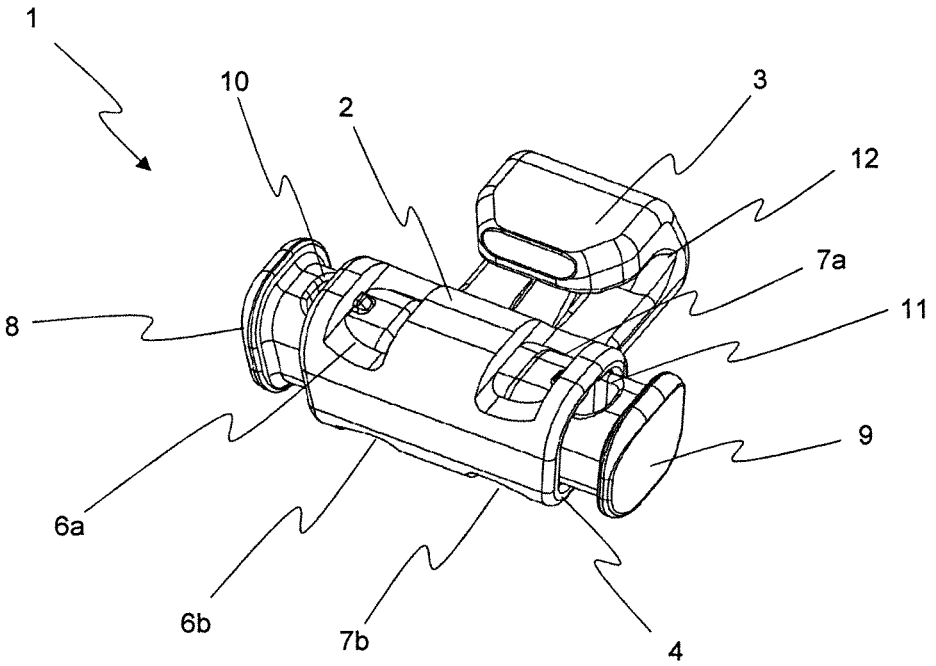
FIG. 1 shows an adjustment unit according to an embodiment of the first aspect of the invention and as it can be used in a fastening device or a wearable article according to the invention.
Figure 2:
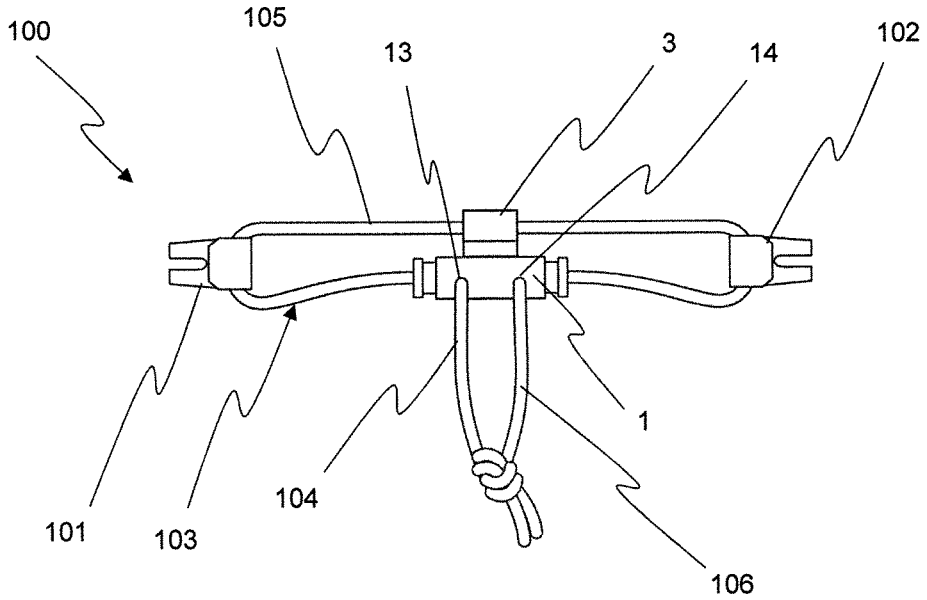
FIG. 2 shows a fastening device according to an embodiment of the second aspect of the invention and as it can be used in a wearable article according to the invention.

FIG. 1 shows an adjustment unit 1 which comprises a main body 2 and an adjustment unit hook element 3 protruding away from the main body 2 and being configured to engage with a fastening cord (see FIG. 2). Adjustment unit hook element 3 defines cord holding receptacle 12 of the adjustment unit 1 which is configured for forming a releasable connection with a fastening cord and which is configured such that the fastening cord can longitudinally be moved through the cord holding receptacle 12. Main body 2 comprises a first and a second locking channel (see 13, 14 in FIG. 2) which can each be switched between a locking configuration and an open configuration. As can be seen each locking channel is in the state shown biased into the locking configuration. Main body 2 comprises tubular housing portion 4 which defines a compartment. Within this compartment two locking structures 8 and 9 are partly inserted. Tubular housing portion 2 defines a first pair of through-going openings 6*a* and 6*b* and a therefrom separated second pair of through-going opening 7*a* and 7*b*. Each opening of each pair is in this or any other embodiment described herein preferably arranged opposite of the second opening of the pair. As can be seen, each through-going opening 6*a*, 6*b*, 7*a*, 7*b* opens from the outside environment into the compartment defined by the tubular housing portion 4. Each locking structure 8 and 9 comprises, respectively delimits through-going locking structure opening 10 and 11. When a user laterally pushes the two locking structures 8 and 9 together, through-going locking structure opening 10 is coaxially arranged with both through-going openings 6*a* and 6*b*, thereby bringing the corresponding locking channel 13 (see FIG. 2) into the open configuration in which it is possible to longitudinally move the adjustment unit 1 along the fastening cord (and vice versa). Accordingly, through-going locking structure opening 10 is coaxially arranged with both through-going opening 7*a* and 7*b*, thereby bringing the corresponding locking channel 14 (see FIG. 2) into the open configuration in which it is possible to longitudinally move the adjustment unit 1 along the fastening cord (and vice versa).

FIG. 2 shows fastening device 100, which comprises an adjustment unit 1 according to an embodiment of the first aspect of the invention, such as adjustment unit 1 shown in FIG. 1. Furthermore, fastening device 100 comprises two distal hook elements 101 and 102 as well as a fastening cord 103, which connect all of these three elements, i.e., the two distal elements 101 and 102 and adjustment unit 1 together. Fastening cord 104 comprises first cord section 104 which extends from a distal end of the fastening cord to adjustment unit 1 and through the first locking channel 13 and from there to distal hook element 101. From distal hook element 101 second cord section 105 extends to the other one of the distal hook elements 102. Third cord section 106 then extends from distal hook element 102 to adjustment unit 1 and through second locking channel 14 up to the other distal end of the fastening cord 103. The adjustment unit hook element 3 is releasably engaged with second section 105 of the fastening cord 103.

Figure 3:
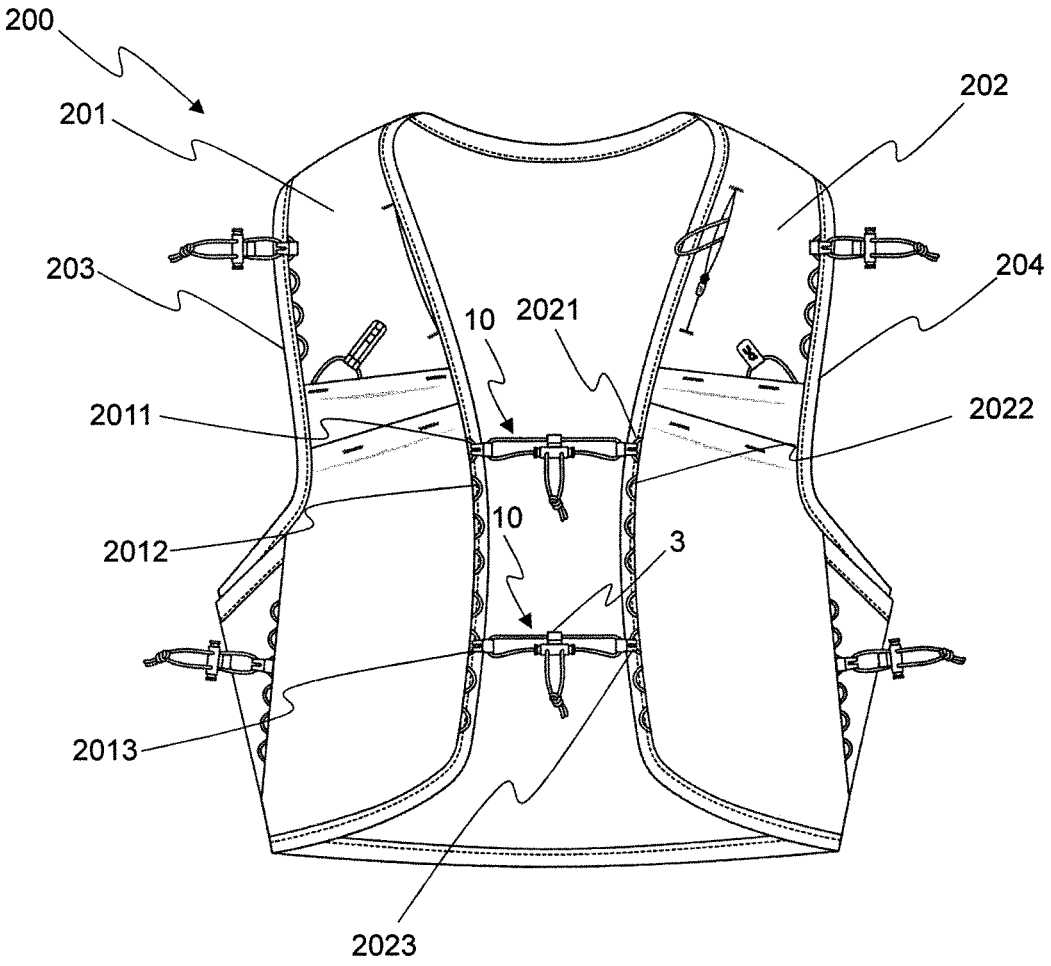
FIG. 3 shows a wearable article according to an embodiment of the invention, particularly of the third aspect of the invention.

FIG. 3 shows wearable article 200 according to a different embodiment of the invention, particularly according to an embodiment of the third aspect of the invention. As can be seen, wearable article 200 comprises a first shoulder strap 201 forming first shoulder loop 203 and a therefrom separated second shoulder strap forming a second shoulder loop 204. The first shoulder strap 201 and the second shoulder strap 202 each comprise eight engagement loops. That is, first shoulder strap 201 comprises eight first engagement loops being arranged one after the other, such as engagement loops 2011, 2012 and 2013 and second shoulder strap 202 comprises eight second engagement loops being arranged one after the other, such as engagement loops 2021, 2022 and 2023. Furthermore, wearable article 200 comprises two separate fastening devices 10. Fastening device 10 comprises two hook elements 101 and 102 (see FIG. 2). Hook element 101 is engaged with first engagement loop 2011 of first shoulder strap 201 and hook element 102 is engaged with second engagement loop 2023 of second shoulder strap 202. Thereby, fastening device 10 connects the two shoulder straps 201 and 202 together. Fastening device 10 further comprises a single adjustment unit 1 (see FIG. 2), which is in this embodiment a central adjustment unit. Furthermore, fastening device 10 comprises a single fastening cord 103 (see FIG. 2). The adjustment unit 1 forms a releasable locking connection with the fastening cord 103. As can be seen, adjustment unit 1 is arranged between the two hook elements 101 and 102. Adjustment unit 1 additionally comprises adjustment unit hook element 3 extending from the main body of the adjustment unit (see FIG. 1). This adjustment hook unit 3 is hooked into fastening cord 103 (see FIG. 2), thereby providing a more comfortable and controlled feeling of the wearer. For assembling wearable article 200, the wearer can first remove fastening devices 10 partially or fully by quickly decoupling one or both hook elements 101 and 102 from the corresponding first or second engagement loop, then put the wearable article onto the body and reconnecting the decoupled hook elements 101 and 102 with the corresponding first or second engagement loop. For tightening the fastening device, the user may release the locking connection between adjustment unit 1 and the fastening cord 103 by laterally pushing on adjustment unit 1 (e.g., onto locking structures 8 and 9, see FIG. 1) from both sides and pulling the fastening cord towards the bottom end and subsequently bringing the adjustment unit 1 again into the locking connection with the fastening cord.

Figure 4:
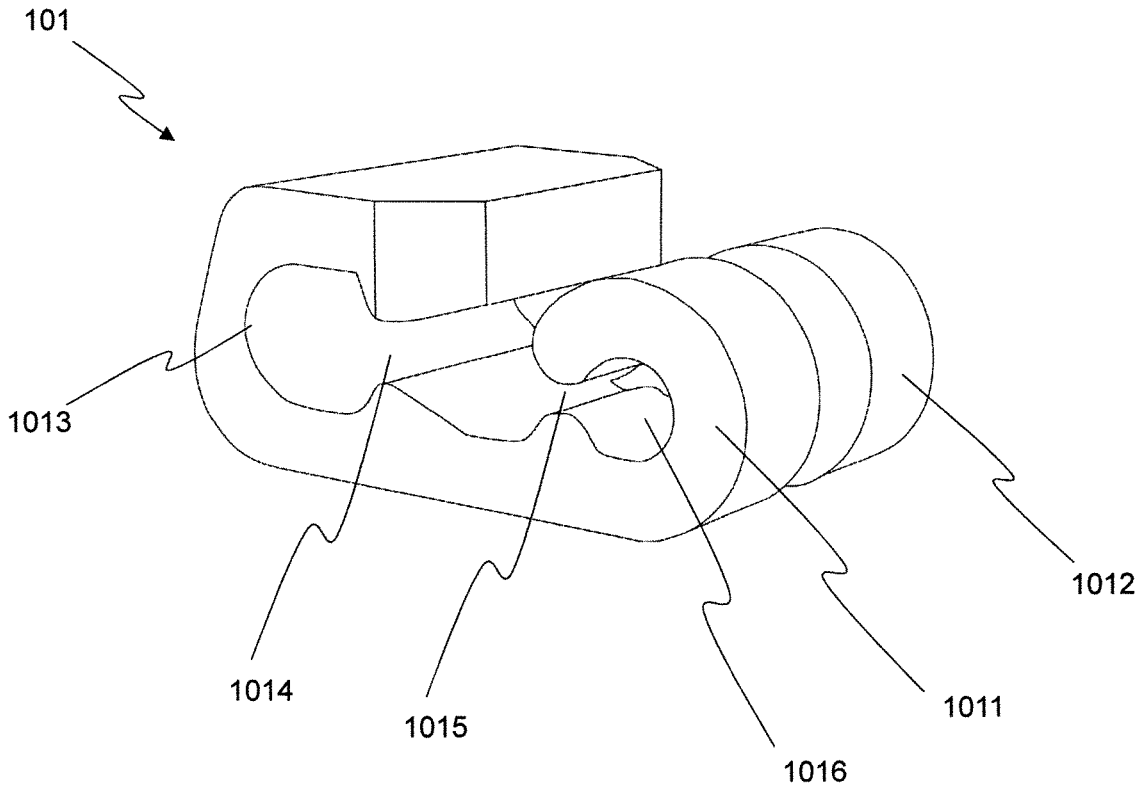
FIG. 4 shows a distal hook element as it can be used in embodiments of the invention.

FIG. 4 shows a distal hook element 101 as it can be used in any fastening device described herein. Distal hook element 101 defines cord holding receptacle 1013, which in the embodiment shown is a groove having a constricted opening 1014 through which the fastening cord can be inserted but which also secures the fastening cord inside the groove. Furthermore, distal hook element 101 comprises two hooks 1011 and 1012 which are arranged one after another. The hooks shown in FIG. 4 extend in parallel to each other, that is they are congruent and can be transformed into each other by linear translation. Each hook, such as hook 1011 defines a groove, such as groove 1016, having a round cross-section and having constricted groove opening 1015.

Figure 5:
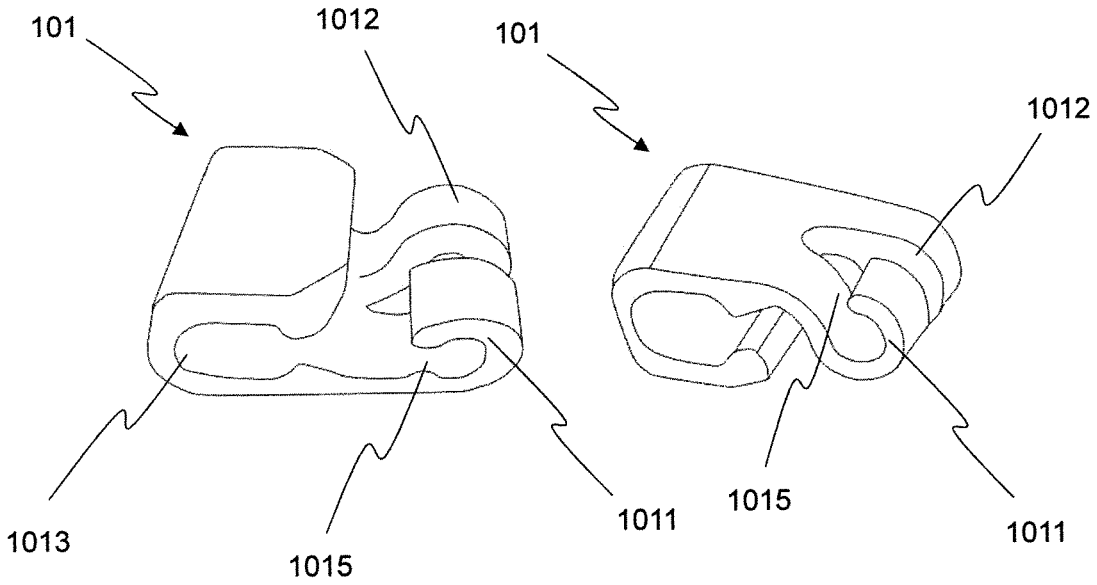
FIG. 5 shows other distal hook elements as it can be used in other embodiments of the invention.

FIG. 5 shows distal hook elements 101, which can also be used in any fastening device described herein. Also, these distal hook elements define cord holding receptacle 1013 and a have each two S-shaped hooks 1011 and 1012 being arranged one after another, but in contrast to the distal hook element shown in FIG. 4, the two hooks 1011 and 1012 do not extend in parallel to each other but extend inversely to each other, i.e., they are congruent to each other in that they can be transformed into each other by point inversion. This entails that the corresponding groove openings of the two hooks 1011 and 1012 are oppositely arranged to each other, which decreases the risk of undesired disconnection of the corresponding fastening device from the first or second engagement loop of a wearable article.

It is claimed:

1. A fastening device (100) for a wearable article, the fastening device (100) comprising two distal hook elements (101, 102), an adjustment unit (1) and a fastening cord (103), the adjustment unit comprising:

a. a main body (2) comprising a first locking channel (13) and a separated second locking channel (14), a tubular housing portion (4), which defines a compartment, a first pair of through-going openings (6*a*, 6*b*) which open into the compartment, a second pair of through-going openings (7*a*, 7*b*) which open into the compartment wherein two locking structures (8, 9) are at least partially arranged inside the compartment, wherein the two locking structures (8, 9) can each be switched along a common lateral axis between a locking configuration and an open configuration and wherein the two locking structures (8, 9) are biased into the locking configuration;

b. an adjustment unit hook element (3) protruding from the main body (2) away from the axis and configured to engage with the fastening cord outside the main body (2), wherein the fastening cord (103) extends through the first locking channel (13) and from the first locking channel to one of the distal hook elements and from there to the other one of the distal hook elements without extending through one of the first pair of through-going openings (6*a*, 6*b*) and the second pair of through-going openings (7*a*, 7*b*) and from the other one of the distal hook elements back to the adjustment unit and through the second locking channel (14), wherein the adjustment unit (1) is arranged between the two distal hook elements (101, 102) and wherein the fastening cord (103) connects the two distal hook elements (101, 102) and the adjustment unit (1) with each other.

2. The fastening device (100) according to claim 1, wherein the adjustment unit (1) is configured such that it is biased into a locking configuration in which it forms a releasable locking connection with the fastening cord (103).

3. The fastening device (100) according to claim 2, wherein the first locking channel (13) and the second locking channel (14) are configured such that longitudinally moving the fastening cord (103) through the first locking channel (13) and/or the second locking channel (14) is possible in the open configuration.

4. The fastening device (100) according to claim 1, wherein the fastening cord (103) has two distal ends protruding from the adjustment unit (1).

5. The fastening device (100) according to claim 4, wherein the two distal ends are connected together by one of a form-locking, force locking and material bonded connection.

6. The fastening device (100) according to claim 1, wherein each distal hook element (101, 102) comprises one or two hooks (1011, 1012) being configured for connecting the fastening device (100) with an engagement loop of the wearable article.

7. The fastening device (100) according to claim 6, wherein each hook (1011, 1012) defines a groove (1016) having a circular cross-section, and wherein each hook (1011, 1012) defines a constricted groove opening (1015).

8. The fastening device (100) according to claim 6, wherein each distal hook element (101, 102) comprises two hooks (1011, 1012) arranged after one another and being spaced apart from each other.

9. The fastening device (100) according to claim 8, wherein the two hooks (1011, 1012) of one of the distal hook elements (101, 102) extend in parallel to each other or extend inversely to each other.

10. The fastening device (100) according to claim 1, wherein each distal hook element (101, 102) defines a cord holding receptacle (1013) which holds the fastening cord (103) in such a way that the fastening cord (103) can longitudinally be moved through the cord holding receptacle (1013).

11. A wearable article (200) having a first shoulder strap (201) and a second shoulder strap (202) each forming a shoulder loop (203, 204) of the wearable article, the wearable article (200) comprising at least one of the fastening devices (10) according to claim 1, wherein the first shoulder strap (201) comprises at least two first engagement loops (2011, 2012, 2013) and wherein the second shoulder strap (202) comprises at least two second engagement loops (2021, 2022, 2023), wherein one of the two distal hook elements (101) is engaged with one of the first engagement loops (2011) of the first shoulder strap (201) and the other one of the two distal hook elements (102) is engaged with one of the second engagement loops (2021) of the second shoulder strap (202).

12. The wearable article (200) of claim 11, wherein the adjustment unit hook element (3) is engaged with a section (105) of the fastening cord (103), which extends between the two distal hook elements (101, 102).

13. The wearable article (200) according to claim 11 comprising two or more fastening devices (10) which extend in parallel to each other.

14. The wearable article (200) according to claim 11, wherein the two distal ends of the fastening cord (103) are freely protruding from the adjustment unit (1).

15. A wearable article (200) according to claim 11 wherein the wearable article comprises one of a vest, a bag and a backpack.

16. A fastening device (100) for a wearable article according to claim 1 wherein the wearable article includes two shoulder straps.

17. A fastening device (100) for a wearable article, the fastening device (100) comprising two distal hook elements (101, 102), an adjustment unit (1) and a single fastening cord (103), the adjustment unit comprising:

a. a main body (2) comprising a first locking channel (13) and a separated second locking channel (14), a tubular housing portion (4), which defines a compartment, a first pair of through-going openings (6*a*, 6*b*) which open into the compartment, a second pair of through-going openings (7*a*, 7*b*) which open into the compartment wherein two locking structures (8, 9) are at least partially arranged inside the compartment, wherein the two locking structures (8, 9) can each be switched along a common lateral axis between a locking configuration and an open configuration and wherein the two locking structures (8, 9) are biased into the locking configuration;

b. an adjustment unit hook element (3) protruding from the main body (2) away from the axis and configured to engage with the single fastening cord outside the main body (2), wherein the single fastening cord (103) extends through the first locking channel (13) and from the first locking channel to one of the distal hook elements and from there to the other one of the distal hook elements without extending through one of the first pair of through-going openings (6*a*, 6*b*) and the second pair of through-going openings (7*a*, 7*b*) and from the other one of the distal hook elements back to the adjustment unit and through the second locking channel (14), wherein the adjustment unit (1) is arranged between the two distal hook elements (101, 102) and wherein the single fastening cord (103) connects the two distal hook elements (101, 102) and the adjustment unit (1) with each other.

* * * * *